US007903073B2

(12) United States Patent
Chung et al.

(10) Patent No.: US 7,903,073 B2
(45) Date of Patent: Mar. 8, 2011

(54) DISPLAY AND METHOD OF TRANSMITTING IMAGE DATA THEREIN

(75) Inventors: Chun-Fan Chung, Hsin-Chu (TW); Sheng-Kai Hsu, Hsin-Chu (TW); Yung-Tse Cheng, Hsin-Chu (TW); Szu-Che Yeh, Hsin-Chu (TW); Li-Ru Lyu, Hsin-Chu (TW); Chih-Sung Wang, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 692 days.

(21) Appl. No.: 11/947,153

(22) Filed: Nov. 29, 2007

(65) Prior Publication Data

US 2009/0091527 A1 Apr. 9, 2009

(30) Foreign Application Priority Data

Oct. 5, 2007 (TW) ..... 96137563 A

(51) Int. Cl.
*G09G 3/36* (2006.01)

(52) U.S. Cl. ..... 345/99; 345/98; 345/103

(58) Field of Classification Search ..... 345/98, 345/99, 103
See application file for complete search history.

(56) References Cited

U.S. PATENT DOCUMENTS 6,822,718 B2 11/2004 Choi et al.
6,825,845 B2 * 11/2004 Nally ..... 345/545
6,867,759 B1 * 3/2005 Baek et al. ..... 345/99
7,196,685 B2 3/2007 Lee et al.
7,209,134 B2 4/2007 Chun et al.
2005/0289422 A1 * 12/2005 Lin et al. ..... 714/730
2006/0007114 A1 * 1/2006 Shiraishi ..... 345/103
2006/0125757 A1 6/2006 Kang et al.
2006/0256099 A1 11/2006 Tashiro

FOREIGN PATENT DOCUMENTS

TW 545009 8/2003

OTHER PUBLICATIONS

English language translation of abstract of TW 545009.

* cited by examiner

*Primary Examiner* — Amare Mengistu
*Assistant Examiner* — Premal Patel
(74) *Attorney, Agent, or Firm* — Thomas, Kayden, Horstemeyer & Risley, LLP

(57) ABSTRACT

A display is provided. The display includes a first timing controller, a second timing controller and drivers. The first timing controller receives and transmits a first portion of pixel values, in which the first portion of the pixel values includes the pixel values of at least two non-adjacent pixels. The second timing controller receives and transmits a second portion of the pixel values, in which the second portion of the pixel values includes the pixel values of at least two non-adjacent pixels. Each of the drivers receives respectively a part of the first portion of the pixel values transmitted by the first timing controller and a part of the second portion of the pixel values transmitted by the second timing controller. A method of transmitting image data in the display is also disclosed.

15 Claims, 8 Drawing Sheets

DISPLAY AND METHOD OF TRANSMITTING IMAGE DATA THEREIN

RELATED APPLICATIONS

This application claims priority to Taiwan Patent Application Serial Number 96137563, filed Oct. 5, 2007, which is herein incorporated by reference.

BACKGROUND

1. Field of Invention

The present invention relates to a display and a method of transmitting image data therein. More particularly, the present invention relates to a method of transmitting image data of a liquid crystal display by using timing controllers and source drivers to perform data transmission and data distribution.

2. Description of Related Art

For a conventional liquid crystal display, image data can be transmitted only by a dual-port low voltage differential signaling (LVDS) transmission interface, and thus a timing controller which receives and transmits the image data in the liquid crystal display is also designed to have a dual-port LVDS transmission interface to meet the requirement for data transmission.

However, if the display resolution or frequency increases, the conventional dual-port LVDS transmission interface used for data transmission is not enough and is replaced by a quad-port LVDS transmission interface. As a result, two timing controllers with dual-port LVDS transmission interface are necessary to meet the requirement for data transmission.

Furthermore, when the quad-port LVDS transmission interface is used for data transmission, the condition of data transmission and data distribution is different from that of the dual-port LVDS transmission interface. Therefore, when the quad-port LVDS transmission interface is used for data transmission, the image data has to be distributed by a data distributor, and then transmitted to source drivers through two timing controllers, respectively. Accordingly, the production cost of the liquid crystal display will also increase, and the data transmission will become more complicated.

SUMMARY

In accordance with one embodiment of the present invention, a method of transmitting image data in a display is provided, in which the image data includes a plurality of pixel values. The method comprises the steps of transmitting a first portion of the pixel values of the image data to a first timing controller, in which the first portion of the pixel values of the image data includes the pixel values of at least two non-adjacent pixels; transmitting a second portion of the pixel values of the image data to a second timing controller, in which the second portion of the pixel values of the image data includes the pixel values of at least two non-adjacent pixels; transmitting a part of the first portion of the pixel values of the image data to one of a plurality of drivers by the first timing controller; and transmitting respectively a part of the second portion of the pixel values of the image data to one of the drivers by the second timing controller.

In accordance with another embodiment of the present invention, a display is provided. The display includes a first timing controller, a second timing controller and a plurality of drivers. The first timing controller receives and transmits a first portion of a plurality of pixel values, in which the first portion of the pixel values includes the pixel values of at least two non-adjacent pixels. The second timing controller receives and transmits a second portion of the pixel values, in which the second portion of the pixel values includes the pixel values of at least two non-adjacent pixels. Each of the drivers receives respectively a part of the first portion of the pixel values delivered by the first timing controller and a part of the second portion of the pixel values delivered by the second timing controller.

For the foregoing embodiments of the present invention, the display and the method of transmitting image data therein can be applied without a data distributor, so as to reduce the production cost and increase the efficiency of the data transmission as well.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference to the accompanying drawings as follows.

DESCRIPTION OF THE PREFERRED EMBODIMENTS

In the following detailed description, the embodiments of the present invention have been shown and described. As will be realized, the invention is capable of modification in various respects, all without departing from the invention. Accordingly, the drawings and description are to be regarded as illustrative in nature and not restrictive.

Figure 1:
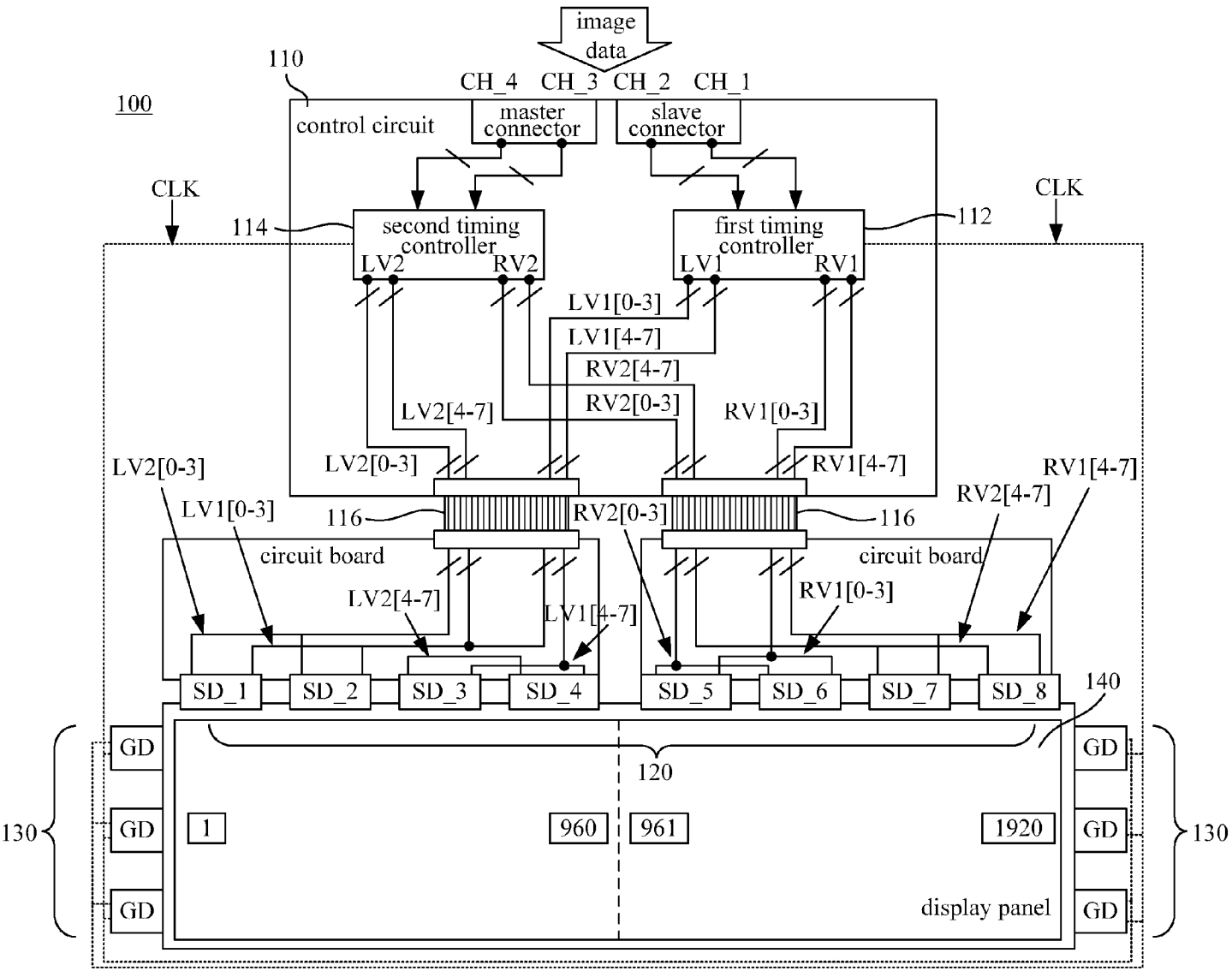
FIG. 1 shows one embodiment of the present invention.

FIG. 1 shows one embodiment of the present invention. The liquid crystal display 100 includes a control circuit 110, a plurality of source drivers 120, a plurality of gate drivers (GD) 130 and a display panel 140, in which the control circuit 110 further comprises a first timing controller 112 and a second timing controller 114. The control circuit 110 receives a plurality of pixel values of the image data through the input channels, i.e. CH_1, CH_2, CH_3 and CH_4, for instance not limited to the number, of a quad-port low voltage differential signaling (LVDS) transmission interface. The first timing controller 112 receives and transmits a first portion of the pixel values of the image data, and the second timing controller 114 receives and transmits a second portion of the pixel values of the image data, in which the first and second portion of the pixel values both include the pixel values of at least two non-adjacent pixels. Each of the source drivers 120 has at least two inputs respectively receiving a part of the first portion of the pixel values delivered by the first timing controller 112 and a part of the second portion of the pixel values delivered by the second timing controller 114, and also receives the clock signals respectively transmitted by the first timing controller 112 and the second timing controller 114.

Furthermore, the first portion of the pixel values of the image data, which is received and transmitted by the first timing controller 112, is different from the second portion of the pixel values of the image data, received and transmitted by the second timing controller 114. Each of the source drivers 120 sequentially and alternately receives the first portion of the pixel values and the second portion of the pixel values. In one embodiment, the first portion of the pixel values includes a plurality of odd pixel values, and the second portion of the pixel values includes a plurality of even pixel values.

Figure 2:
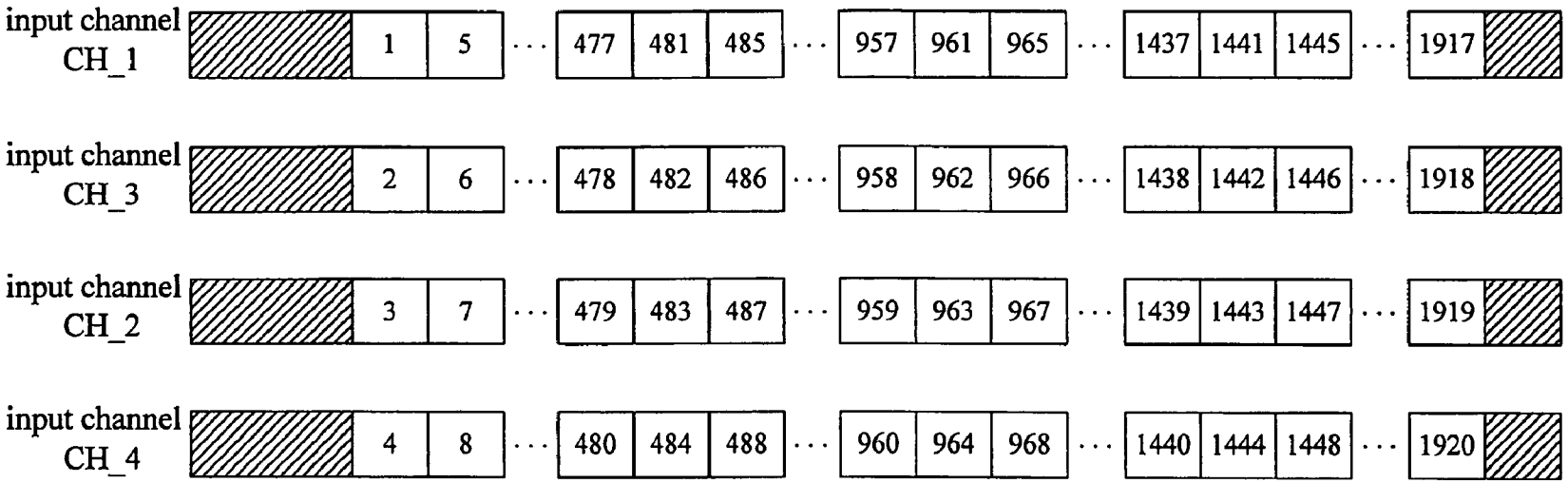
FIG. 2 shows the data transmission of the control circuit, as shown in FIG. 1, for receiving the pixel values through the LVDS transmission interface according to one embodiment of the present invention.
Figure 3:
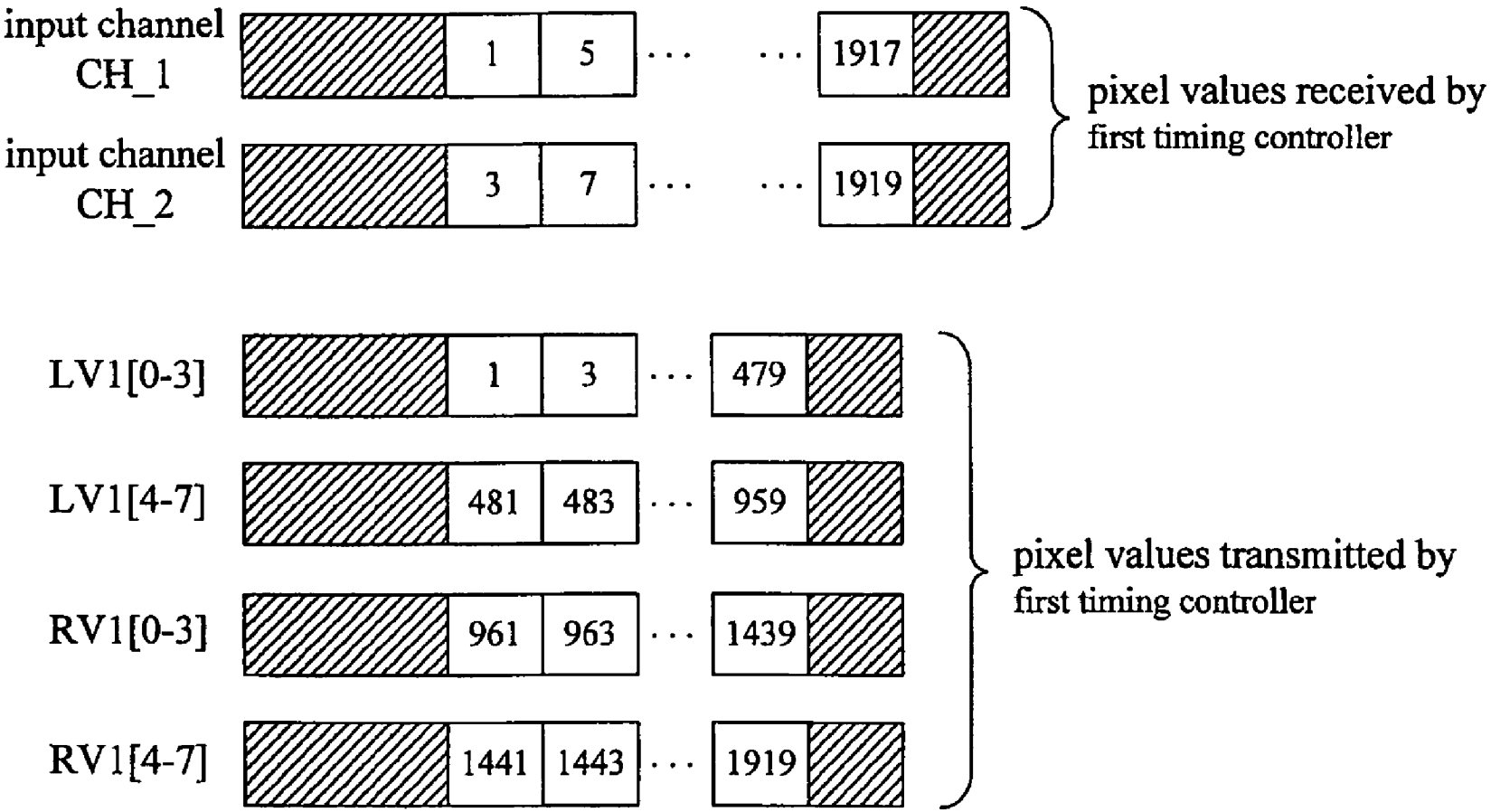
FIG. 3 shows the data transmission of the first timing controller, as shown in FIG. 1, for receiving and transmitting the pixel values according to one embodiment of the present invention.
Figure 4:
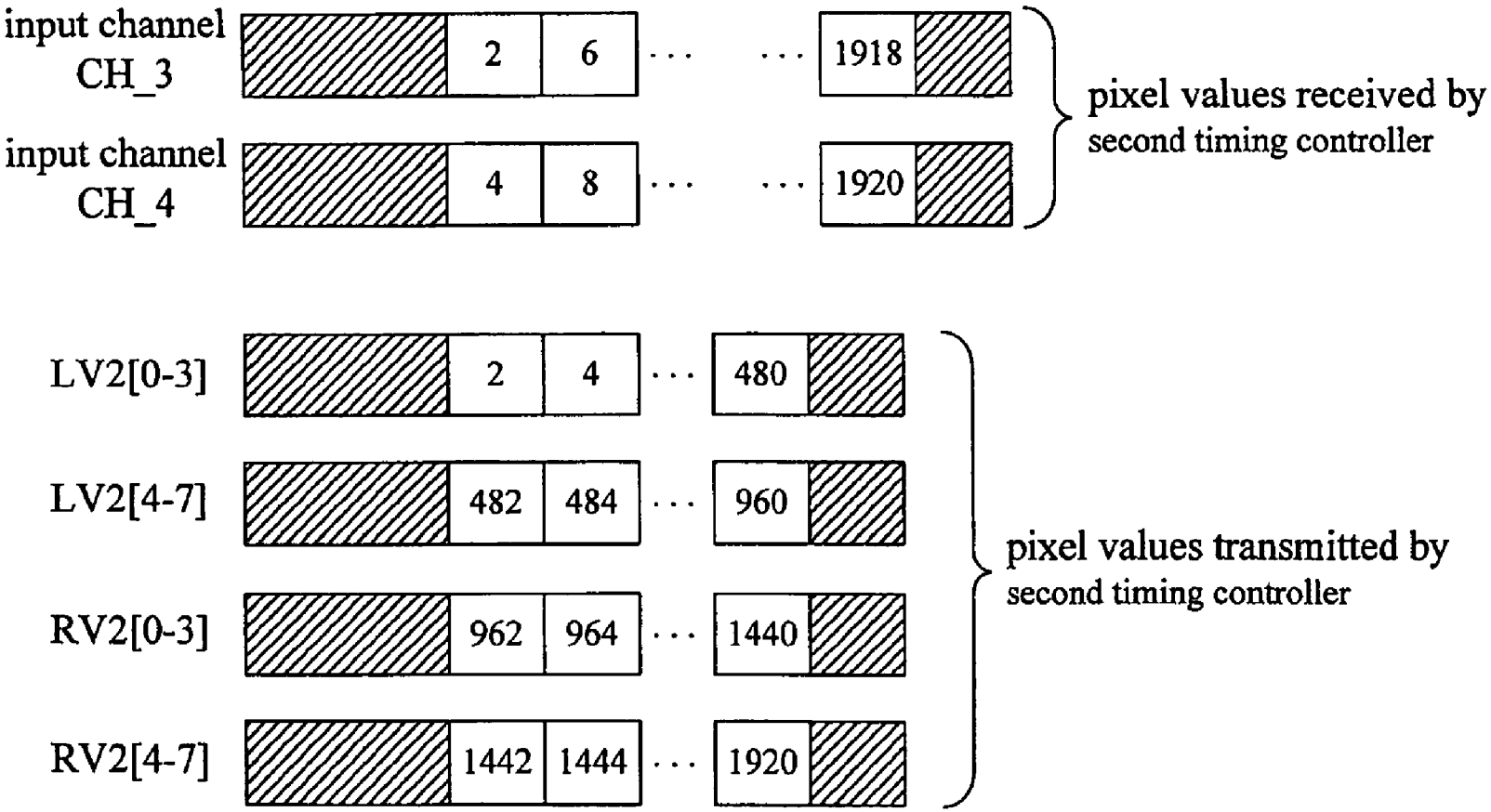
FIG. 4 shows the data transmission of the second timing controller, as shown in FIG. 1, for receiving and transmitting the pixel values according to one embodiment of the present invention.

An embodiment is referred to as follows to describe the data transmission in FIG. 1. FIG. 2 shows the data transmission of the control circuit 110 in FIG. 1 for receiving the pixel values through the LVDS transmission interface according to one embodiment of the present invention. FIG. 3 shows the data transmission of the first timing controller 112 in FIG. 1 for receiving and transmitting the pixel values according to one embodiment of the present invention. FIG. 4 shows the data transmission of the second timing controller 114 in FIG. 1 for receiving and transmitting the pixel values according to one embodiment of the present invention. Refer to FIGS. 1, 2, 3 and 4. In the present embodiment, the image data includes 1920 pixel values, and these pixel values are transmitted to the source drivers SD_1, SD_2 . . . and SD_8, respectively. First, the image data is transmitted to the control circuit 110 through the LVDS input channels, i.e. CH_1, CH_2, CH_3 and CH_4, in which the pixel values 1, 5, . . . and 1917 and the pixel values 3, 7, . . . and 1919 are transmitted to the first timing controller 112 through the input channels CH_1 and CH_2, respectively, and the pixel values 2, 6, . . . and 1918 and the pixel values 4, 8, . . . and 1920 are transmitted to the second timing controller 114 through the input channels CH_3 and CH_4, respectively.

After the first timing controller 112 receives the pixel values, the received pixel values are separated into four parts, i.e. LV1[0-3], LV1[4-7], RV1[0-3] and RV1[4-7], for transmission, in which LV1[0-3] represents the pixel values 1, 3, . . . and 479; LV1[4-7] represents the pixel values 481, 483, . . . and 959; RV1[0-3] represents the pixel values 961, 963, . . . and 1439; and RV1[4-7] represents the pixel values 1441, 1443, . . . and 1919. The pixel values of LV1[0-3] and LV1[4-7] are transmitted to the source drivers SD_1, SD_2, SD_3 and SD_4, respectively, through the flexible flat cable (FFC) 116. The pixel values of RV1[0-3] and RV1[4-7] are transmitted to the source drivers SD_5, SD_6, SD_7 and SD_8, respectively, through the FFC 116.

At the same time, after the second timing controller 114 receives the pixel values, the received pixel values are also separated into four parts, i.e. LV2[0-3], LV2[4-7], RV2[0-3] and RV2[4-7], for transmission, in which LV2[0-3] represents the pixel values 2, 4, . . . and 480; LV2[4-7] represents the pixel values 482, 484, . . . and 960; RV2[0-3] represents the pixel values 962, 964, . . . and 1440; and RV2[4-7] represents the pixel values 1442, 1444, . . . and 1920. The pixel values of LV2[0-3] and LV2[4-7] are transmitted to the source drivers SD_1, SD_2, SD_3 and SD_4, respectively, through the FFC 116. The pixel values of RV2[0-3] and RV2[4-7] are transmitted to the source drivers SD_5, SD_6, SD_7 and SD_8, respectively, through the FFC 116.

After that, the corresponding gate drivers (GD) 130 turn on the pixels according to the clock signals transmitted by the first timing controller 112 and the second timing controller 114, then the source drivers 120 transmit the pixel values to the corresponding pixels such that the pixel values 1, 2, 3, . . . and 1920 are sequentially displayed on the display panel 140.

Figure 5:
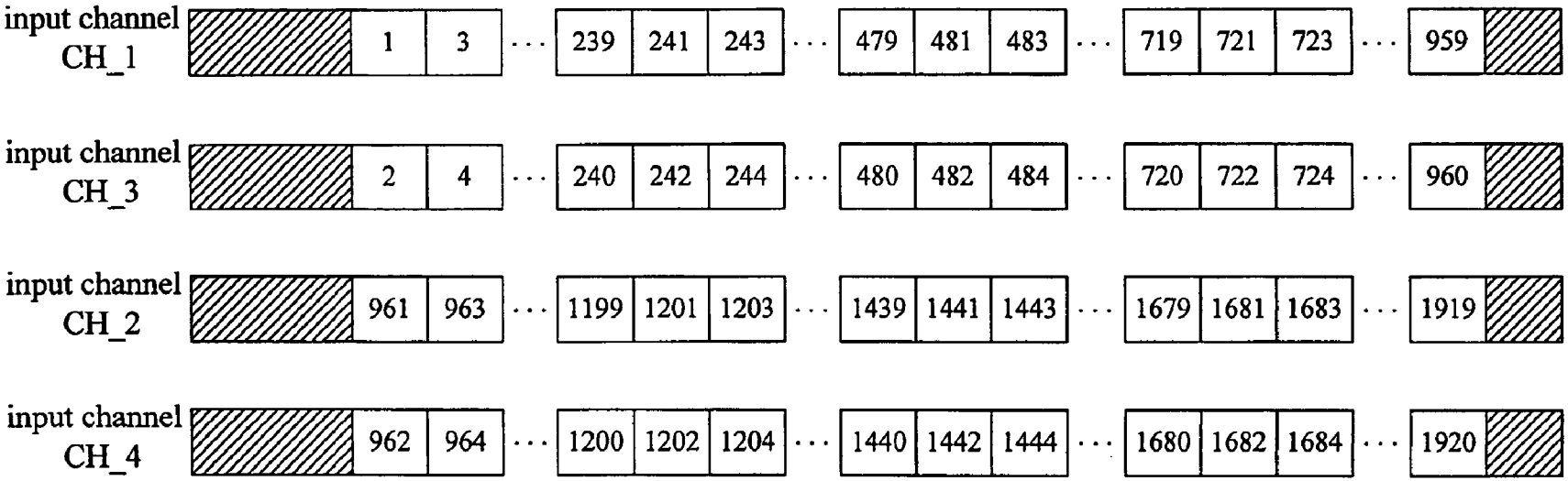
FIG. 5 shows the data transmission of the control circuit, as shown in FIG. 1, for receiving the pixel values through the LVDS transmission interface according to another embodiment of the present invention.
Figure 6:
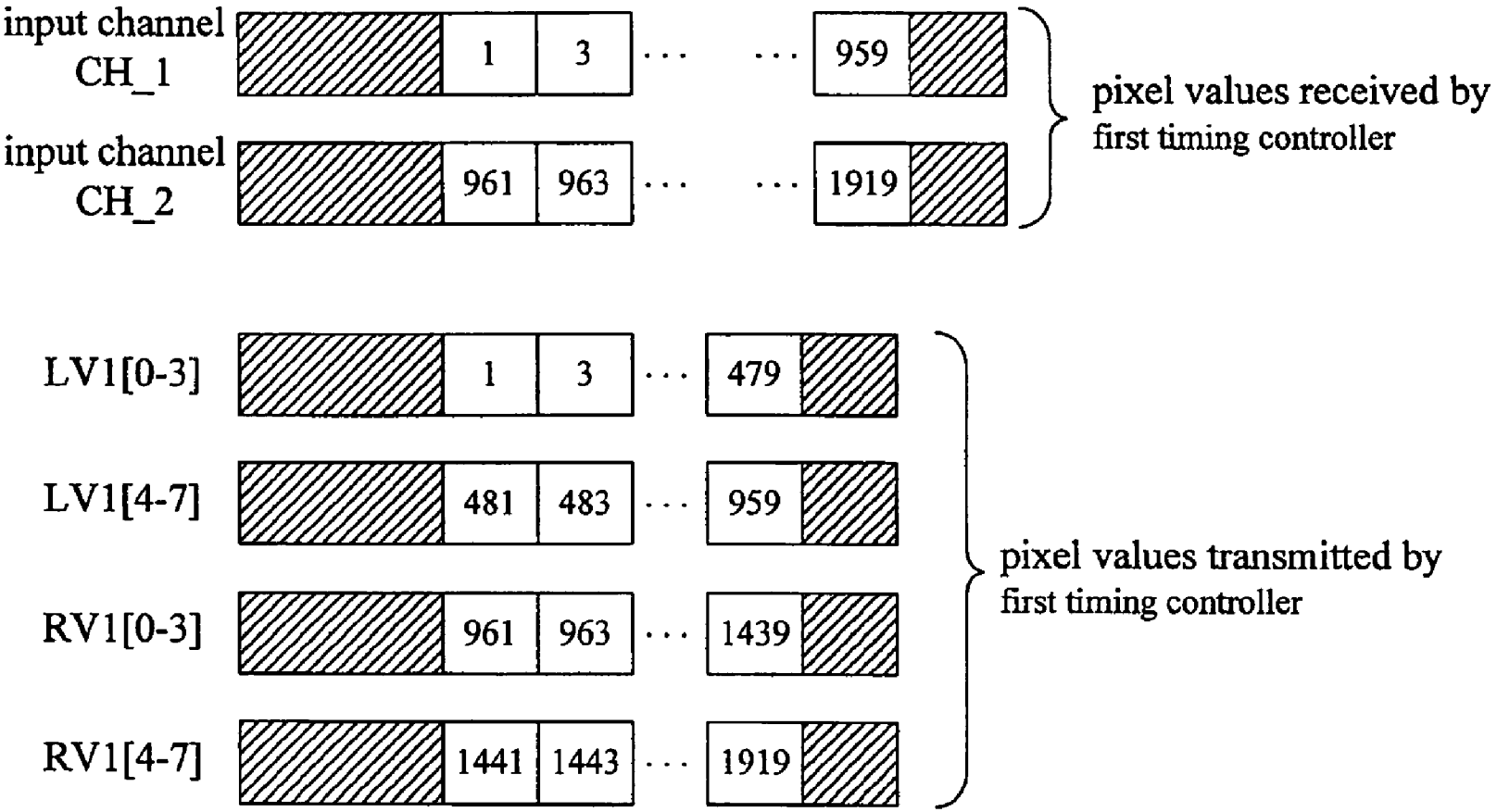
FIG. 6 shows the data transmission of the first timing controller, as shown in FIG. 1, for receiving and transmitting the pixel values according to another embodiment of the present invention.
Figure 7:
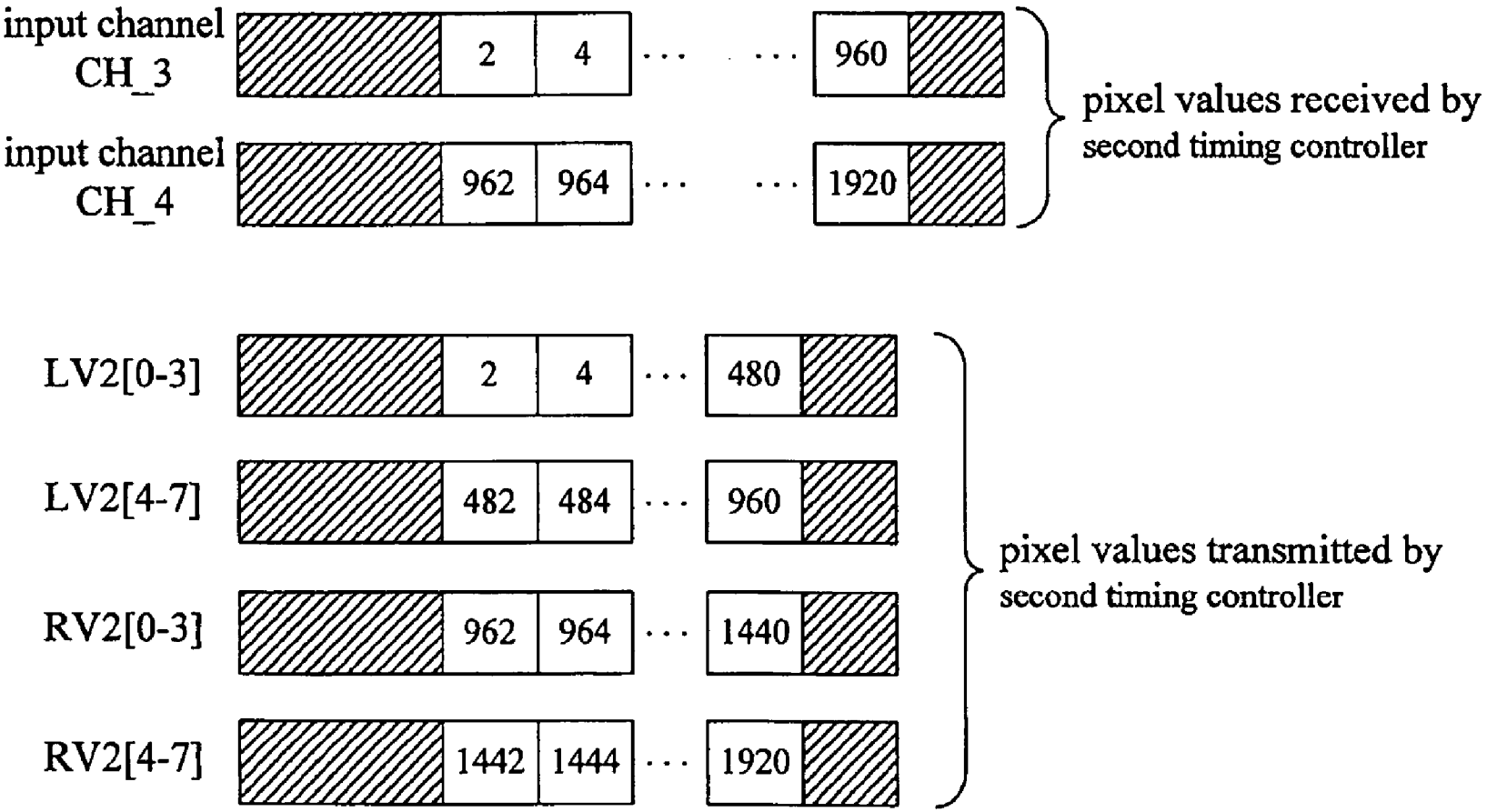
FIG. 7 shows the data transmission of the second timing controller, as shown in FIG. 1, for receiving and transmitting the pixel values according to another embodiment of the present invention.

Another embodiment is described as follows. FIG. 5 shows the data transmission of the control circuit 110, as shown in FIG. 1, for receiving the pixel values through the LVDS transmission interface according to another embodiment of the present invention. FIG. 6 shows the data transmission of the first timing controller 112, as shown in FIG. 1, for receiving and transmitting the pixel values according to another embodiment of the present invention. FIG. 7 shows the data transmission of the second timing controller 114, as shown in FIG. 1, for receiving and transmitting the pixel values according to another embodiment of the present invention. Refer to FIGS. 1, 5, 6 and 7. Similarly, in the present embodiment, the image data including 1920 pixel values is transmitted to the control circuit 110 through the LVDS input channels, i.e. CH_1, CH_2, CH_3 and CH_4, in which the pixel values 1, 3, . . . and 959 and the pixel values 961, 963, . . . and 1919 are transmitted to the first timing controller 112 through the input channels CH_1 and CH_2, respectively, and the pixel values 2, 4, . . . and 960 and the pixel values 962, 964, . . . and 1920 are transmitted to the second timing controller 114 through the input channels CH_3 and CH_4, respectively; that is, the first timing controller 112 receives the odd pixel values, and the second timing controller 114 receives the even pixel values.

Similarly, after the first timing controller 112 receives the pixel values, the received pixel values are separated into four parts, i.e. LV1[0-3], LV1[4-7], RV1[0-3] and RV1[4-7], for transmission, in which LV1[0-3] represents the pixel values 1, 3, . . . and 479; LV1[4-7] represents the pixel values 481, 483, . . . and 959; RV1[0-3] represents the pixel values 961, 963, . . . and 1439; and RV1[4-7] represents the pixel values 1441, 1443, . . . and 1919. The pixel values of LV1[0-3] and LV1[4-7] are transmitted to the source drivers SD_1, SD_2, SD_3 and SD_4, respectively, through the FFC 116. The pixel values of RV1[0-3] and RV1[4-7] are transmitted to the source drivers SD_5, SD_6, SD_7 and SD_8, respectively, through the FFC 116.

At the same time, after the second timing controller 114 receives the pixel values, the received pixel values are similarly separated into four parts, i.e. LV2[0-3], LV2[4-7], RV2[0-3] and RV2[4-7], for transmission, in which LV2[0-3] represents the pixel values 2, 4, . . . and 480; LV2[4-7] represents the pixel values 482, 484, . . . and 960; RV2[0-3] represents the pixel values 962, 964, . . . and 1440; and RV2[4-7] represents the pixel values 1442, 1444, . . . and 1920. The pixel values of LV2[0-3] and LV2[4-7] are transmitted to the source drivers 120 SD_1, SD_2, SD_3 and SD_4, respectively, through the FFC 116. The pixel values of RV2[0-3] and RV2[4-7] are transmitted to the source drivers120 SD_5, SD_6, SD_7 and SD_8, respectively, through the FFC 116.

After that, the gate drivers 130 turn on the pixels according to the clock signals transmitted by the first timing controller 112 and the second timing controller 114, then the source drivers 120 transmit the pixel values to the corresponding pixels such that the pixel values 1, 2, 3 . . . 1920 are sequentially displayed on the display panel 140.

Figure 8:
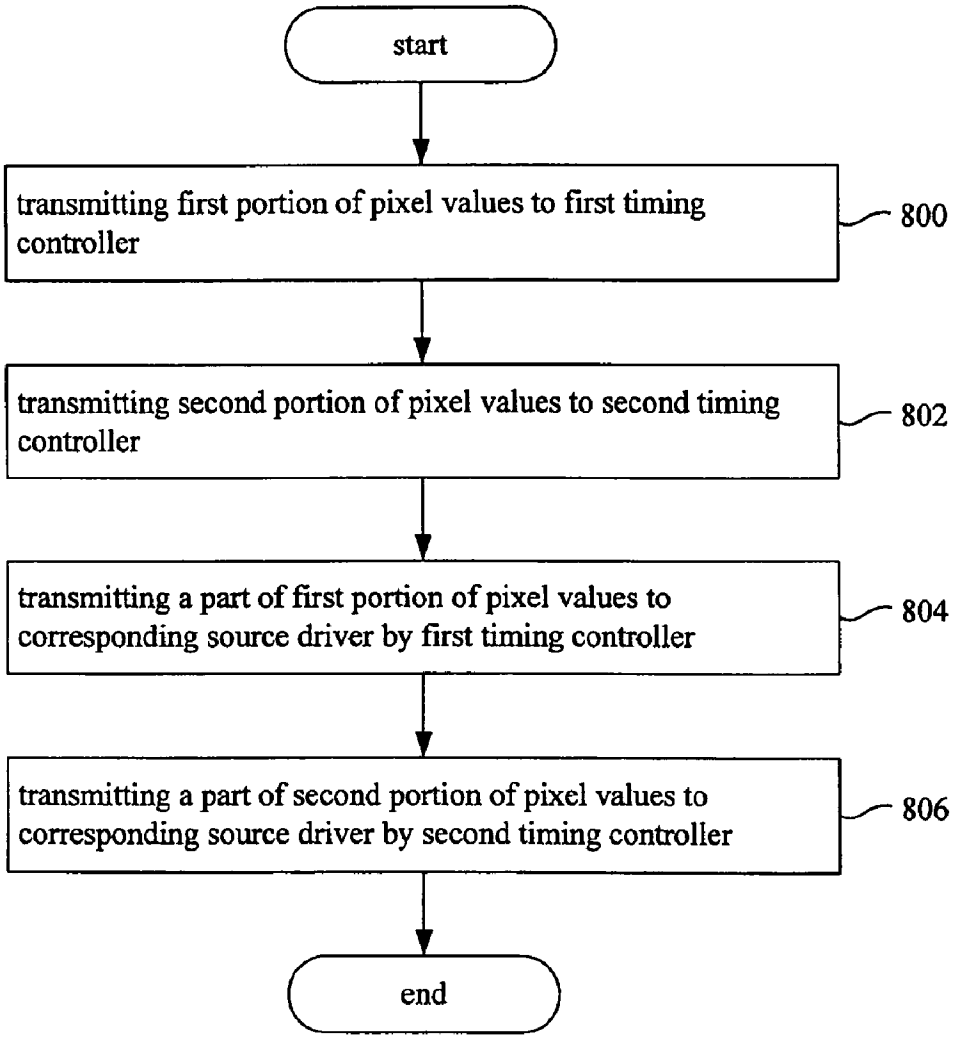
FIG. 8 shows a flow chart of the method of transmitting the image data in the liquid crystal display shown in FIG. 1.

FIG. 8 shows a flow chart of the method of transmitting the image data in the liquid crystal display shown in FIG. 1. Refer to FIGS. 1 and 8. First, in step 800, the first portion of a plurality of pixel values of the image data is transmitted to the first timing controller 112, in which the first portion of the pixel values includes the pixel values of at least two non-adjacent pixels. Then, in step 802, the second portion of the pixel values of the image data is transmitted to the second timing controller 114, in which the second portion of the pixel values includes the pixel values of at least two non-adjacent pixels. The sequence of Step 800 and Step 802 are not limited as shown in FIG. 8; instead, both Step 800 and Step 802 can be performed at the same time or alternately. Moreover, the first portion of the pixel values transmitted to the first timing controller 112 is different from the second portion of the pixel values transmitted to the second timing controller 114. In one embodiment, the first portion of the pixel values includes a plurality of odd pixel values, and the second portion of the pixel values includes a plurality of even pixel values.

After that, in Step 804, a part of the first portion of the pixel values is transmitted to one corresponding source driver 120 by the first timing controller 112, and then a part of the second portion of the pixel values is transmitted to one corresponding source driver 120 by the second timing controller 114 (Step 806). Similarly, the sequence of Step 804 and Step 806 are not limited as shown in FIG. 8; instead, both Step 804 and Step 806 can be performed at the same time or alternately.

As a result, the pixel values of the image data are not required to be distributed by the data distributor and then transmitted by the timing controllers. Instead, the pixel values can be directly received by the timing controllers and then delivered to the corresponding source drivers; that is, each of the source drivers receives the pixel values delivered by two timing controllers, and then sequentially outputs the received pixel values to be displayed.

For the foregoing embodiments of the present invention, the liquid crystal display and the method of transmitting image data therein can be applied to directly receive the image data by the timing controllers through the LVDS transmission interface, and to transmit the image data to the source drivers, respectively, so as to save an extra data distributor in the liquid crystal display, reduce the production cost, simplify the data transmission, and increase the efficiency of the data transmission.

As is understood by a person skilled in the art, the foregoing embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A method of transmitting image data in a display, wherein the image data comprises a plurality of pixel values, the method comprising:

transmitting a first portion of the pixel values of the image data from a first input channel and a second input channel to a first timing controller, wherein the first portion of the pixel values of the image data comprises the pixel values of at least two non-adjacent pixels;

transmitting a second portion of the pixel values of the image data from a third input channel and a fourth input channel to a second timing controller, wherein the second portion of the pixel values of the image data comprises the pixel values of at least two non-adjacent pixels;

the first timing controller transmitting a first part of the first portion of the pixel values to a first part of drivers and transmitting a second part of the first portion of the pixel values to a second part of drivers; and the second timing controller transmitting a first part of the second portion of the pixel values to the first part of drivers and transmitting the second part of the second portion of the pixel values to the second part of the drivers, wherein the first part of the drivers and the second part of the drivers drives different sections of the display.

2. The method of claim 1, wherein the first portion of the pixel values of the image data and the second portion of the pixel values of the image data are sequentially and alternately transmitted to each of the drivers.

3. The method of claim 1, wherein the first portion of the pixel values of the image data transmitted to the first timing controller comprises a plurality of odd pixel values.

4. The method of claim 1, wherein the second portion of the pixel values of the image data transmitted to the second timing controller comprises a plurality of even pixel values.

5. The method of claim 1, wherein the first portion of the pixel values of the image data transmitted to the first timing controller is different from the second portion of the pixel values of the image data transmitted to the second timing controller.

6. The method of claim 1, further comprising:

transmitting a first clock signal and a second clock signal to the drivers by the first timing controller and the second timing controller respectively.

7. The method of claim 1, wherein the pixel values from the first input channel and the second input channel are alternately transmitted to the first timing controller, and the pixel values from the third input channel and the fourth input channel are alternately transmitted to the second timing controller.

8. The method of claim 1, wherein the pixel values from the first input channel and the second input channel are sequentially transmitted to the first timing controller, and the pixel values from the third input channel and the fourth input channel are sequentially transmitted to the second timing controller.

9. A display, comprising:

a first timing controller for receiving a first portion of a plurality of pixel values from a first input channel and a second input channel, wherein the first portion of the pixel values comprises the pixel values of at least two non-adjacent pixels;

a second timing controller for receiving a second portion of the pixel values from a third input channel and a fourth input channel, wherein the second portion of the pixel values comprises the pixel values of at least two non-adjacent pixels; and a plurality of drivers, the first timing controller transmitting a first part of the first portion of the pixel values to a first part of drivers and transmitting a second part of the first portion of the pixel values to a second part of drivers, and the second timing controller transmitting a first part of the second portion of the pixel values to the first part of drivers and transmitting the second part of the second portion of the pixel values to the second part of the drivers, wherein the first part of the drivers and the second part of the drivers drives different sections of the display.

10. The display of claim 9, wherein each of the drivers has at least two inputs for receiving the first portion of the pixel values transmitted by the first timing controller and the second portion of the pixel values transmitted by the second timing controller, respectively.

11. The display of claim 9, wherein each of the drivers is configured to receive a first clock signal transmitted by the first timing controller and a second clock signal transmitted by the second timing controller.

12. The display of claim 9, wherein the first portion of the pixel values received and transmitted by the first timing controller comprises a plurality of odd pixel values.

13. The display of claim 9, wherein the second portion of the pixel values received and transmitted by the second timing controller comprises a plurality of even pixel values.

14. The display of claim 9, wherein each of the drivers is configured to sequentially and alternately receive the first portion of the pixel values and the second portion of the pixel values.

15. The display of claim 9, wherein the first portion of the pixel values received and transmitted by the first timing controller is different from the second portion of the pixel values received and transmitted by the second timing controller.

* * * * *